US006039038A

United States Patent [19]

Buck et al.

[11] Patent Number: 6,039,038

[45] Date of Patent: Mar. 21, 2000

[54] DRILLING ASSISTING DEVICE FOR HAND-GUIDED DRILL

[75] Inventors: Manfred Buck, Nuertingen; Wolfgang Brost, Leinfelden-Echterdingen; Robert Handschuh, Remseck; Helmut Kratt, Spaichingen, all of Germany

[73] Assignee: Robert Bosch GmbH, Stuttgart, Germany

[21] Appl. No.: 09/016,005

[22] Filed: Jan. 30, 1998

[30] Foreign Application Priority Data

Feb. 3, 1997 [DE] Germany ..... 197039111

[51] Int. Cl.[7] ..... B28D 5/04

[52] U.S. Cl. ..... 125/39

[58] Field of Search ..... 125/20, 39; 451/160; 408/67, 97, 110, 234, 712

[56] References Cited

U.S. PATENT DOCUMENTS

| | | | |
|---|---|---|---|
| 135,642 | 2/1873 | Gear | 125/39 X |
| 3,837,121 | 9/1974 | Schirmer | 451/160 |
| 3,888,049 | 6/1975 | MacSween | 451/361 X |
| 3,890,058 | 6/1975 | Self et al. | 408/712 X |
| 4,076,007 | 2/1978 | Redlin | 125/30 R |
| 4,200,417 | 4/1980 | Hager et al. | 408/67 |
| 4,500,235 | 2/1985 | Johnsen | 408/234 X |
| 4,582,105 | 4/1986 | Wolff | 408/712 X |
| 4,652,184 | 3/1987 | Fischer | 408/67 |
| 4,684,303 | 8/1987 | Erdt et al. | 408/712 X |
| 5,062,743 | 11/1991 | Wieland et al. | 408/135 X |
| 5,113,951 | 5/1992 | Houben et al. | 408/67 X |
| 5,244,048 | 9/1993 | Moorhead, Sr. | 408/712 X |
| 5,413,440 | 5/1995 | Willson et al. | 408/234 X |
| 5,713,702 | 2/1998 | Turner | 408/712 X |

*Primary Examiner*—David A. Scherbel
*Assistant Examiner*—Anthony Ojini
*Attorney, Agent, or Firm*—Michael J. Striker

[57] ABSTRACT

A drilling assisting device for a drill used for diamond drilling, has a supporting element, a unit for mounting on a drill arranged on the supporting element at a machine side, a support part for supporting the drill on a surface to be treated and also mounted on the supporting element at a tool side, the unit for mounting on the drill having a carriage, a dove-tail unit for setting the carriage on the drill, and a bolt unit mounting the carriage on the drill.

16 Claims, 5 Drawing Sheets

10
11
12
13
14
14a
14b
15
16
17
19
20
21
22
23
24
25
30
31
32
33
34
35
36
38
39
40
41
42
43
44
45
56
70
71
d

DRILLING ASSISTING DEVICE FOR HAND-GUIDED DRILL

BACKGROUND OF THE INVENTION

The present invention relates to a drilling assisting device for hand-guided drill, in particular for diamond drilling.

The drilling is a critical moment for the hand-guided drilling process. If the tool guidance through a bore hole is not correct, then due to rotation of the tool tip the tool can be broken. Damages to the outer surface of the tool are then unavoidable. Because of this, drilling assisting devices are utilized during drilling. They usually provide an additional support for the drilling device on the surface of the workpiece.

Drilling assisting devices are known in the art. The known drilling assisting devices include one or two supporting elements which are mounted by a clamping mounting on a clamping neck of the drill. The supporting element is provided with a supporting part at the side of the tool. It serves for supporting on the surface to be treated and concentrically surrounds the drilling tool. Moreover, the connecting part during wet drilling serves as a capture ring for cooling water which flows from the drilling location.

Known drilling assisting devices with a single supporting element have a disadvantage which is connected with their cylindrical form. In particular, the supporting part, when the drilling tool is not inserted, does not provide a clear orientation for the machine or drill axis. Drilling assisting devices with two supporting elements eliminate this disadvantage, however they are relatively inconvenient, since the supporting elements extend relatively wide in a lateral direction. The application of the pressure to the supporting part is performed through spiral springs which are supported before the supporting part and the clamping mounting, and during pressing of the drill relative to the drilling product they are compressed. Such spiral springs has a relatively steep characteristic, which is not favorable since in the case of great drilling depth, the pressing force applied by the operator increases over proportionally. The usable pressing path in these embodiments is shortened by the length of the compressed spring pack. With increasing the drilling depth, the supporting element extends behind the clamping ring and posses an obstacle to the operator during handling of the drill.

SUMMARY OF THE INVENTION

Accordingly, it is an object of present invention to provide a drilling assisting device for a drill, in particular for diamond drilling, which avoids the disadvantages of the prior art.

In keeping with these objects, one feature of the invention resides in a drilling assisting device in which means for mounting on the drill have a carriage which is fittable on the drill through a dove-tail connection and is mountable on the drill by a bolt.

When the drilling assisting device is designed in accordance with the present invention, it has the advantage that it is mountable on the drill in an especially simple and handling-convenient manner, and simultaneously provides a stable holding of the supporting part. For setting and withdrawal of the drilling assisting device on or from the drill, no additional auxiliary means or tools are needed.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
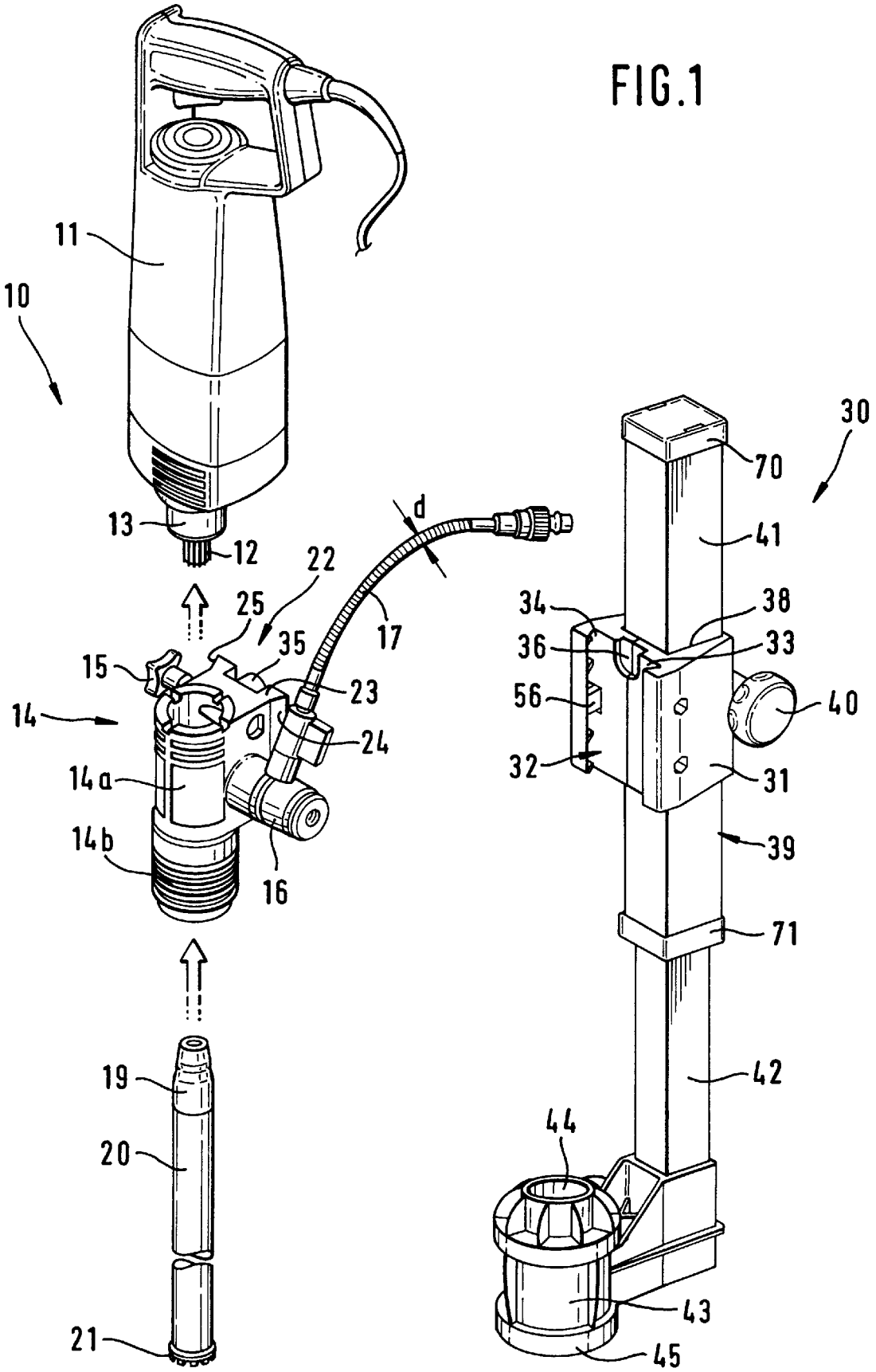
FIG. 1 is a perspective view of a partially dismounted components of a drill for hand-guided drilling.

A drilling assisting device in accordance with present invention is used for a drilling device identified as a whole with reference numeral 10. The drilling device is provided with a power drill 11 which has a clamping neck 13 at its drive side with an output shaft 12 extending from the clamping neck. A rinsing head 14 is mountable on the power drill 11 and fixed by a screw handle 15 on the clamping neck 13. The rinsing head 14 has a housing 14*a* which forms a tool receptacle 14*b*. It also has a connecting pipe 16 for supplying a cooling water which is connectable to a supply hose 17.

A shaft 19 of a drilling crown 20 is axially insertable into the two receptacle 14*b*. At the other end it is provided with a blade 21. The blade 21 has a cutting head composed conventionally of hard alloy or diamond.

A mounting plate 23 is also formed on the rinsing head 14. It is provided with guiding strips 24 and 25. The mounting plate 23 together with the guiding strips 24, 25 forms a dove-tail guide 22. The guide 22 serves selectively for mounting on a drilling assisting device 30 or on a not shown stationary drill support.

The drilling assisting device 30 is shown in perspective of FIG. 1. The drilling assisting device 30 has means for mounting on a machine and formed as a carriage 31. The carriage 31 is provided with corresponding dove-tail shaped receptacle 32. The dove-tail guide 22 is insertable in the dove-tail receptacle 32, and the guiding strip 24, 25 engage in the corresponding guiding grooves 33, 34 of the dove-tail receptacle 32. The dove-tail guide 22 is insertable from above into the dove-tail receptacle 32 until an abutment pin 35 arranged on the dove-tale guide 22 comes to abutment in an abutment opening 36 of the carriage 31.

Figure 2:
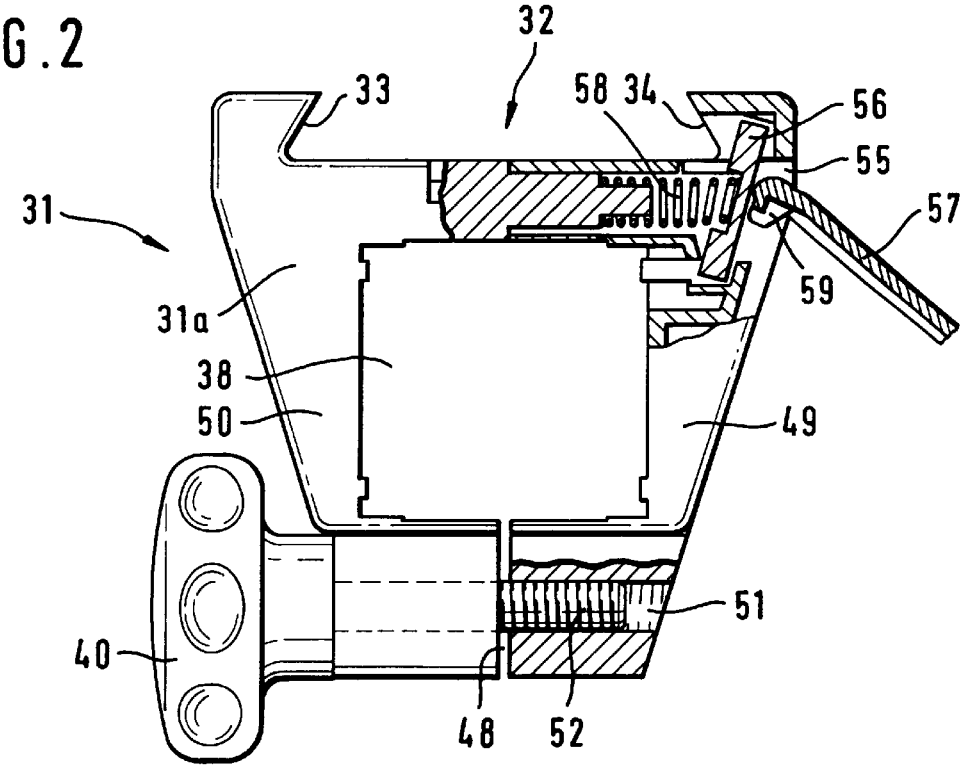
FIGS. 2 and 3 are views showing a partial section of a mounting carriage of a drilling assisting device in accordance with present invention.
Figure 3:
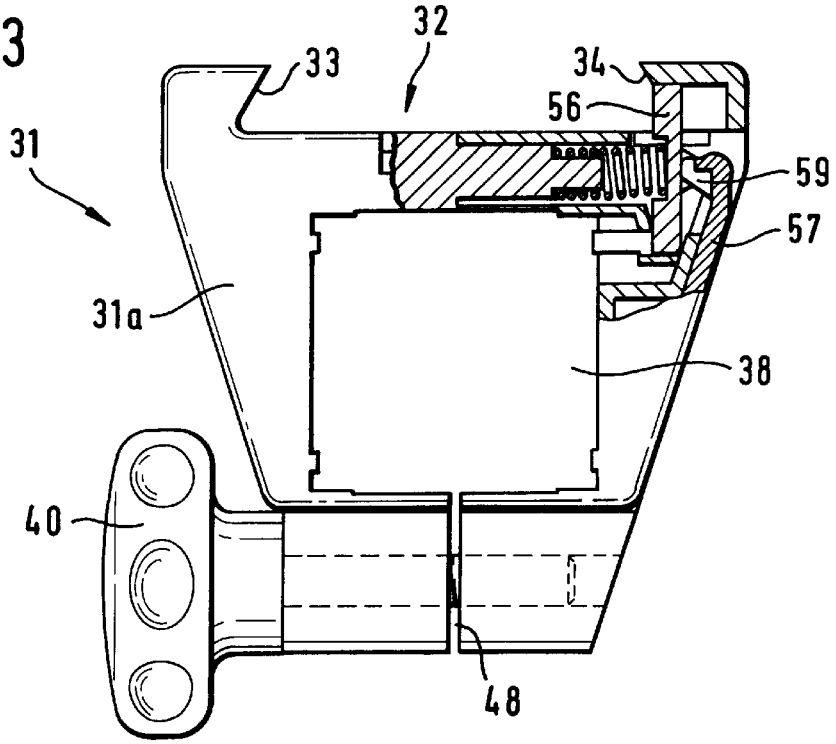

The carriage 31 has a receiving opening 38 shown in FIGS. 2 and 3. A supporting element 39 is inserted in the receiving opening. The supporting element is fixable on the carriage 31 by a rotary handle 40 of a clamping device.

The supporting element 39 is composed of a profiled tube of a light construction, for example of aluminum. It has a receiving part 41 formed as a four-corner tube. A hollow four-corner extension part 42 is telescopably insertable in the receiving part 41. A supporting part 43 is mounted on the free end of the extension part 42. The supporting part 43 has a throughgoing opening 44 which receives the drilling crown 20 and guides the same. At the end which is opposite to the drilling product, the supporting part 43 has a circumferential sealing or adhesion edge 45 for sealing or for adhesion on the treatment surface.

FIGS. 2 and 3 show the carriage 31. The carriage has a base body 31*a* with a receiving opening 38 for the supporting element 39. A slot 48 extends in the base body 31 at one side through the wall of the receiving opening 38. It separates the base body 31 into two opposite clamping jaws 49 and 50. A first clamping jaw 49 is provided with a threaded opening 51. A screw 52 which extends through a throughgoing opening in the other clamping jaw 50 is screwable in the threaded opening 41. The screw 52 is rotatable by a rotary handle 40. During screwing-in of the screw 52, the clamping jaws 49, 50 move toward one another in the region of the slot 48 so that the receiving opening 38 is reduced and the clamping jaws 49, 50 can firmly clamp on the periphery of the supporting element 39.

The dove-tail receptacle 32 provided with the guiding grooves 33, 34 is located at the side of the base body 31 which is opposite to the slot 48. A recess 55 in the base body 31 opens toward the guiding groove 34. A bolt 56 is located in the recess 55 and insertable through a lever 57 into the guiding groove 34 of the dove-tail receptacle 32. The bolt 56 is pretensioned in direction toward its release position shown in FIG. 2, by a spring 58. The lever 57 is turnably held on the base body 31*a* whereas an eccentric 59 formed on the lever 57 abuts against the bolt 56.

The bolt 56 is bringable into the position in which it engages in the guiding groove 34 by actuation of the lever 57 as shown in FIG. 3. The lever 57 abuts with its actuating arm against the base body 31*a* and the eccentric 59 blocks the bolt 56. The bolt 56 can abut against the base body 31*a* with its end which faces away from the guiding groove 34. It is provided that the bolt 56 for blocking the drilling assisting device 30 on the drill 10, with the housing 14*a* completely inserted in the dove-tail receptacle 32, form lockingly engages in the recess located in the dove-tail guide 22 in the region of the guiding strip 24.

Figure 4:
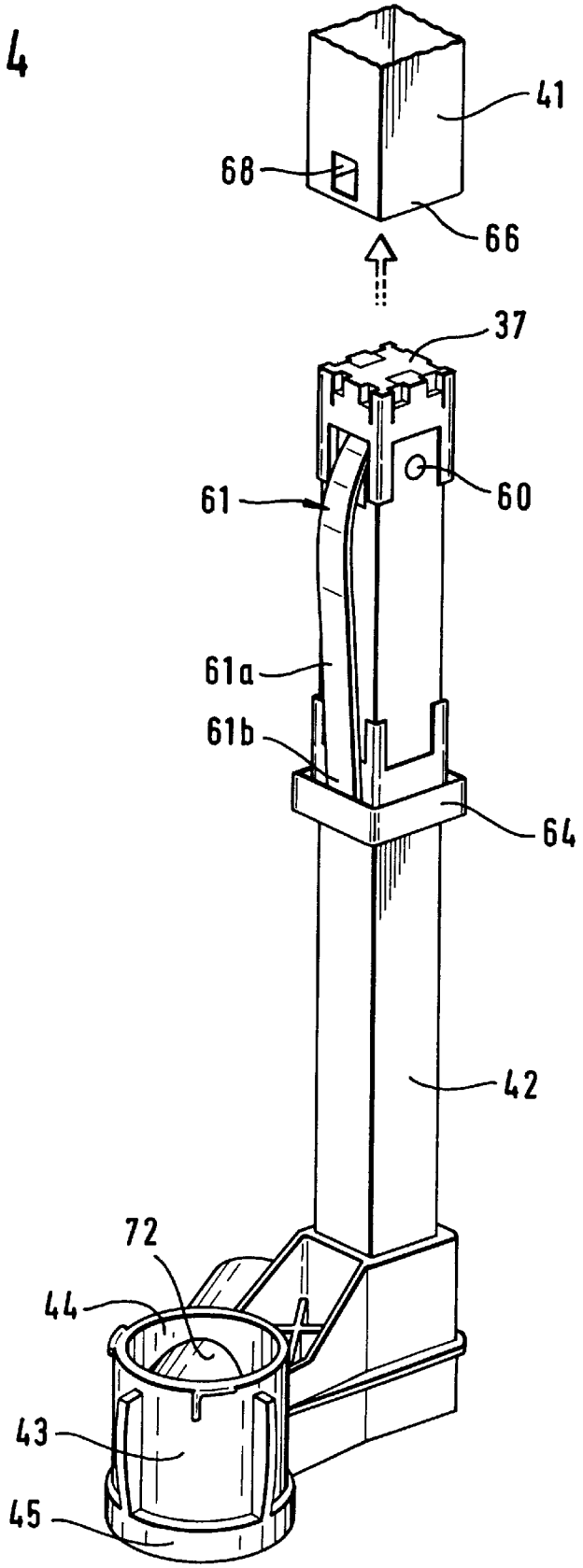
FIG. 4 is a view showing an insert part of the inventive drilling assisting device.
Figure 5:
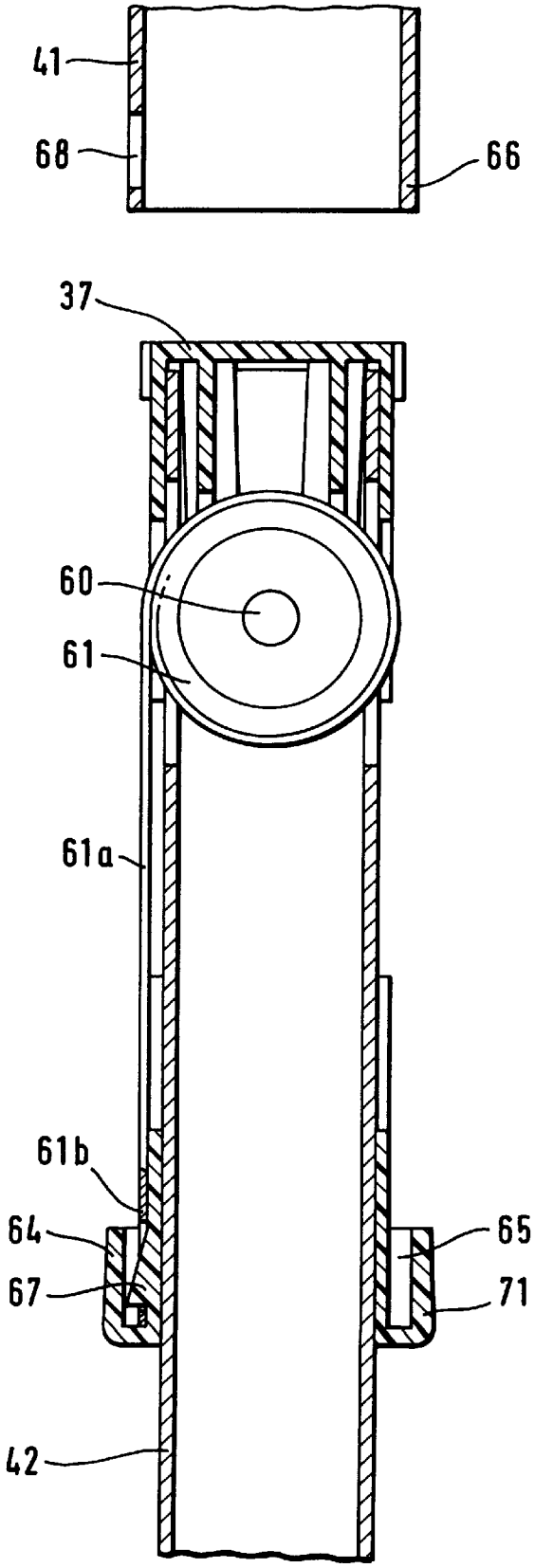
FIG. 5 is a view showing a section through the insert part of FIG. 4.

FIG. 4 shows the extension part 42 in its position in which it is dismounted from the receiving part 41. The extension part 42 is supported on the end of a pin 60 which faces the receiving part 41, on which an inner spring end of a roller spring 61 is fixedly anchored. The pin is secured by a cap 37. The roller spring 61 is composed of a spiral shaped wound spring sheet 61*a*. A pullable end 61*b* of the roller spring 61 is mounted on a guiding part 64. The guiding part 64 is axially displaceably guided on the extension part 42 and has a receiving groove 65 for a front end 66 of the receiving part 41. As can be seen from FIG. 5, an arresting projection 67 is provided on the guiding part 64 inside the receiving pocket 65. With the mounted supporting element 69, it engages into an arresting recess 65 in the receiving part 41. With the engaging receiving part 41, the pullable end 61*b* of the roller spring 61 is simultaneously secured on the guiding part 64.

When the roller spring 61 is loaded, it is wound. It pulls its end 61*b* in direction to the pin 60. Since the guiding part 64 is held on the receiving part 41, the extension part 42 is loaded in the tool direction. In other words, the supporting element 39 is always brought by the roller spring 61 to a position in which it is pulled from the receiving part 41. When the supporting element 49 is pressed against a surface to be treated, the supporting element 39 is shortened by insertion of the extension part 42 into the receiving part 41 with simultaneous pulling out and clamping of the roller spring 61.

Figure 6:
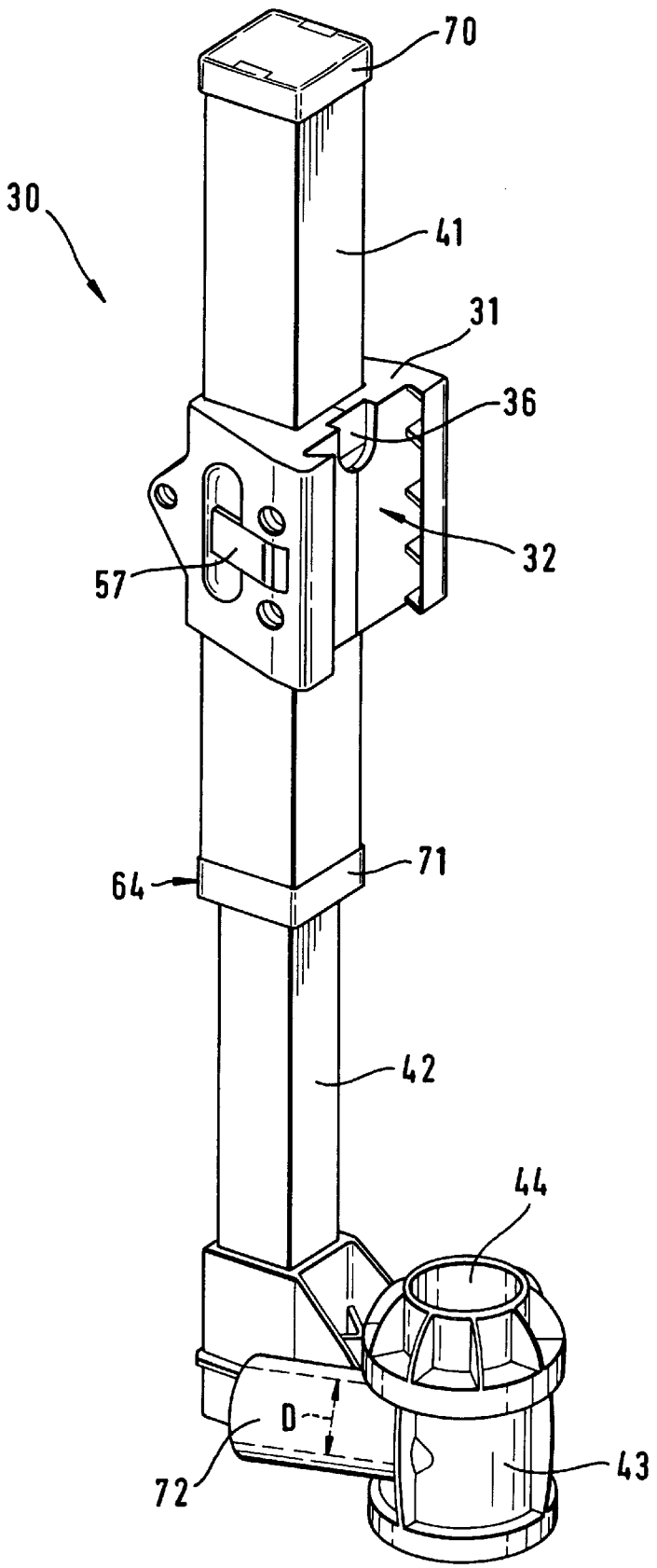
FIG. 6 is a perspective view of the drilling assisting device in accordance with the present invention.

FIG. 6 shows the drilling assisting device 30 in an opposite prospective view relative to FIG. 1. The receiving part 41 is covered at the machine side by a cap 70. The carriage 31 is displaceably guided on the receiving part 41, and the lever 57 is held on the carriage. The extension part 42 extends at the tool side outwardly beyond the receiving part 41. From the guiding part 61, a region 31 which outwardly limits the receiving pocket 65 is illustrated. The supporting part 43 is mounted on the free end of the extension part 42 and a connection pipe 72 projects laterally from it. The connection pipe 72 is connected with the interior of the throughgoing opening 44 and serves selectively for aspiration of cooling water/drilling particles during wet drilling or drilling particles during dry drilling. For this reason, the connecting pipe 72 is formed for connection to a dry/wet aspirating device. The connecting pipe 72 is provided for this purpose with a substantially great cross-section D. In view of the air fraction to be aspirated, it is substantially greater, for example twice as great, than an efficient cross-section d of the cooling waterdsupply hose 17.

The present invention is not limited to the illustrated example. The bolt 56 can be formed also as a force-transmitting clamping bolt. The dove-tail guide 22 can be formed on the carriage 31 and then the dove-tail receptacle 32 is formed on the rinsing head 14. Instead of the rinsing head 14, the dove-tail receptacle or guide can be formed also on the drill.

It will be understood that each of the elements described above, or two or more together, may also find a useful application in other types of constructions differing from the types described above.

While the invention has been illustrated and described as embodied in drilling assisting device for hand-guided drill, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A drilling assisting device for a drill used for diamond drilling, comprising a supporting element; means for mounting on a drill arranged on said supporting element at a machine side; a support part for supporting the drill on a surface to be treated and also mounted on said supporting element at a tool side, said means for mounting on the drill having a carriage; dovetail means for setting said carriage on the drill said carriage on the drill; and bolt means mounting said carriage on the drill, said supporting element having a receiving part and an extension part telescopably movable in said receiving part, said extension part being spring biased on said receiving part in a pulling out direction.

2. A drilling assisting device as defined in claim 1, wherein said carriage has a receiving opening for a receiving part.

3. A drilling assisting device as defined in claim 1, wherein said carriage is adjustably fixable on said supporting element.

4. A drilling assisting device as defined in claim 1, wherein said carriage has a base body having a wall and a slot extending through said wall to a receiving opening.

5. A drilling assisting device as defined in claim 1, wherein said supporting part has a throughgoing opening for passage of a drilling tool and is provided with a connection pipe intersecting said throughgoing opening in a transverse direction.

6. A drilling assisting device as defined in claim 5; and further comprising a supply hose, said connection pipe having a cross-section which is at least twice as great as an effective cross-section of said supply hose.

7. A drilling assisting device as defined in claim 5, wherein said connection pipe is connectable to wet suction device.

8. A drilling assisting device as defined in claim 5, wherein said connection pipe is connectable to a dry suction device.

9. A drilling assisting device for a drill used for diamond drilling, comprising a supporting element; means for mounting on a drill arranged on said supporting element at a machine side; a support part for supporting the drill on a surface to be treated and also mounted on said supporting element at a tool side, said means for mounting on the drill having a carriage; dovetail means for setting said carriage on the drill said carriage on the drill; and bolt means mounting said carriage on the drill, said supporting element having a receiving part and an extension part telescopably movable in said receiving part, said extension part having a portion engaging in said receiving part and being formed as a roller spring with an inner end and a pullable out end; and a pin on which said inner end is fixed, said pullable out end being fixedly connected with said receiving part.

10. A drilling assisting device for a drill used for diamond drilling, comprising a supporting element; means for mounting on a drill arranged on said supporting element at a machine side; a support part for supporting the drill on a surface to be treated and also mounted on said supporting element at a tool side, said means for mounting on the drill having a carriage; dovetail means for setting said carriage on the drill; and bolt means mounting said carriage on the drill, said supporting part having a throughgoing opening for passage of a drilling tool and being provided with a connection pipe intersecting said throughgoing opening in a transverse direction; and a supply hose, said connection pipe having a cross-section which is at least twice as great as an effective cross-section of said supply hose.

11. A drilling assisting device as defined in claim 10, wherein said supporting element has a receiving part and an extension part telescopably movable in said receiving part.

12. A drilling assisting device as defined in claim 11, wherein said receiving part and said extension part are composed of a profile tube of a light material.

13. A drilling assisting device as defined in claim 12, wherein said receiving part and said extension are composed of aluminum.

14. A drilling assisting device as defined in claim 11, wherein said receiving part and said extension part has a four-corner cross-section.

15. A drilling assisting device as defined in claim 11, wherein said extension part is spring biased on said receiving part in a pulling out direction.

16. A drilling assisting device as defined in claim 11, wherein said extension part has a portion engaging in said receiving part and being formed as a roller spring with an inner end and a pullable out end; and further comprising a pin on which said inner end fixed, said pullable end being fixably connected with said receiving part.

* * * * *